US010577737B2

(12) United States Patent
Bae et al.

(10) Patent No.: US 10,577,737 B2
(45) Date of Patent: Mar. 3, 2020

(54) OPERATING METHOD FOR LAUNDRY MACHINE

(71) Applicant: LG Electronics Inc., Seoul (KR)

(72) Inventors: Kwangju Bae, Seoul (KR); Han Kim, Seoul (KR); Dowan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/284,695

(22) Filed: Feb. 25, 2019

(65) Prior Publication Data

US 2019/0186063 A1 Jun. 20, 2019

Related U.S. Application Data

(63) Continuation of application No. 14/458,470, filed on Aug. 13, 2014, now Pat. No. 10,233,581.

(30) Foreign Application Priority Data

Aug. 14, 2013 (KR) ..... 10-2013-0096850

(51) Int. Cl.
*D06F 33/02* (2006.01)
*D06F 39/00* (2020.01)
(Continued)

(52) U.S. Cl.
CPC ..... *D06F 33/02* (2013.01); *D06F 25/00* (2013.01); *D06F 35/005* (2013.01);
(Continued)

(58) Field of Classification Search
None
See application file for complete search history.

(56) References Cited

U.S. PATENT DOCUMENTS 3,616,472 A * 11/1971 Ripsco ..... D06F 33/02 68/12.12
8,881,330 B2 11/2014 Ghosh et al.
(Continued)

FOREIGN PATENT DOCUMENTS

CN 101512058 8/2009
EP 2135988 12/2009
(Continued)

OTHER PUBLICATIONS

European Result of Consultation in European Application No. 14 180 829.5, dated Mar. 13, 2018, 3 pages.
(Continued)

*Primary Examiner* — Cristi J Tate-Sims
(74) *Attorney, Agent, or Firm* — Fish & Richardson P.C.

(57) ABSTRACT

A laundry machine and an operation method for a laundry machine are disclosed. The laundry machine includes a tub configured to receive wash water; a drum that is configured to rotate in the tub and to receive clothes; a control panel configured to receive input from a user; a course selection part located on the control panel and configured to enable user selection of an operating course from a plurality of operating courses; and one or more option selection parts located on the control panel and configured to enable user selection of one or more options for the operating course selected by the user. The operating method includes selecting a specific course and controlling sequential performance of the following operations: cleaning the clothes by supplying wash water to the drum; drying the clothes by supplying hot air to the drum; and refreshing the clothes by supplying steam to the drum.

20 Claims, 6 Drawing Sheets

(51) Int. Cl.

| | |
|---|---|
| ***D06F 58/28*** | (2006.01) |
| ***D06F 25/00*** | (2006.01) |
| ***D06F 35/00*** | (2006.01) |
| *D06F 58/20* | (2006.01) |

(52) U.S. Cl.

CPC ..... *D06F 39/005* (2013.01); *D06F 58/28* (2013.01); *D06F 39/008* (2013.01); *D06F 58/203* (2013.01); *D06F 2058/2803* (2013.01)

(56) References Cited

U.S. PATENT DOCUMENTS

| | | | | |
|---|---|---|---|---|
| 2004/0089029 | A1 | 5/2004 | Sakita et al. | |
| 2006/0137107 | A1* | 6/2006 | Lee | D06F 25/00 8/149.3 |
| 2008/0115292 | A1* | 5/2008 | Park | D06F 33/02 8/149.3 |
| 2009/0071032 | A1 | 3/2009 | Kreutzfeldt et al. | |
| 2010/0005598 | A1* | 1/2010 | Jung | D06F 35/007 8/159 |
| 2010/0146712 | A1 | 6/2010 | Finch et al. | |
| 2012/0012135 | A1 | 1/2012 | Hong et al. | |
| 2012/0209444 | A1* | 8/2012 | Seo | A47L 15/0047 700/295 |
| 2013/0139402 | A1* | 6/2013 | Hong | D06F 58/04 34/427 |
| 2014/0259448 | A1* | 9/2014 | Alexander | D06F 33/02 8/137 |

FOREIGN PATENT DOCUMENTS

| | | | | |
|---|---|---|---|---|
| EP | 2135988 | A1 * | 12/2009 | D06F 39/005 |
| EP | 1852542 | | 3/2011 | |
| EP | 2436827 | | 4/2012 | |
| EP | 2080832 | | 3/2015 | |
| JP | 2002119788 | | 4/2002 | |
| JP | 2008532686 | | 8/2008 | |
| KR | 100156208 | | 12/1988 | |
| KR | 1020090075030 | | 7/2009 | |
| KR | 102013080105 | | 7/2013 | |
| WO | WO2006087735 | | 8/2006 | |
| WO | WO-2006087735 | A1 * | 8/2006 | A47L 15/4293 |
| WO | WO2006098571 | | 9/2006 | |
| WO | WO2006101345 | | 9/2006 | |
| WO | WO2007137857 | | 12/2007 | |

OTHER PUBLICATIONS

European Search Report dated Jan. 21, 2015 from European Application No. 4180829.5, 11 pages.

Office Action issued in Chinese Application No. 201410400035.4 dated Dec. 25, 2015, 23 pages (with English translation).

* cited by examiner

OPERATING METHOD FOR LAUNDRY MACHINE

CROSS REFERENCE TO RELATED APPLICATION

This application is a continuation of U.S. application Ser. No. 14/458,470, filed on Aug. 13, 2014, now allowed, which claims the benefit of Korean Patent Application No. 10-2013-0096850, filed on, Aug. 14, 2013, which are hereby incorporated by reference as if fully set forth herein.

FIELD

The present disclosure relates to an operating method for a laundry machine and, more particularly, to a method of providing user convenience via implementation of washing, drying and refreshing when a specific course is selected upon selection of an operating course.

BACKGROUND

In general, a laundry machine refers to an apparatus that may perform washing and/or drying of clothes and the like. Here, a single laundry machine may perform only washing or drying, or may perform both washing and drying. In addition, in recent years, laundry machines, which include a steam supply device and function to refresh clothes and the like for removal of wrinkles, deodorization, elimination of static cling and the like, have become popular.

Meanwhile, conventional laundry machines are divided into a front loading type or a top loading type according to a withdrawal direction of clothes. In addition, there is a vertical shaft type in which a pulsator or a wash tub is rotated, or a horizontal type in which a drum is rotated, according to a washing method. A representative example of the horizontal type is a drum washing machine or a drum drying machine.

Usually, a laundry machine includes a control panel provided for interfacing with a user. A user inputs or acquires information to or from the laundry machine via the control panel. The control panel is generally provided with a course selection part to select a course and an option selection part to select an option.

In one type of laundry machine having both washing and drying functions (hereinafter referred to as a "combo washing machine" for convenience of description), washing may be a main function and drying may be an auxiliary function. Hence, the combo washing machine is provided with various types of washing courses, and any one of the washing courses may be selected via the course selection part. In addition, drying may be selected via the option selection part.

Herein, a course refers to a course programmed to complete clothes treatment via sequential and automated implementation of a plurality of cycles (strokes). A general washing course is programmed to complete washing by sequentially performing a washing cycle, a rinsing cycle after completion of the washing cycle and a dehydration cycle after completion of the rinsing cycle. Completely washed clothes are generally subjected to natural drying. Of course, in the combo washing machine capable of implementing drying, forced drying may be performed as a drying option is additionally selected after completion of washing. Since drying is generally not a main function even in the combo washing machine, drying may not be performed as a course, but be performed via selection of an option.

There are various washing courses according to the kind of laundry and the like, and the respective washing courses may be programmed with different parameters.

A temperature of wash water, a drum's RPM upon dehydration, a washing time, a drum's RPM upon washing and the like may mean parameters of cycles constituting a washing course, and these parameters may be changed or corrected via selection of options. For example, when a specific washing course having specific parameters is selected, a washing course changed or corrected via selection of options may be performed.

However, such selection of options requires further user labor although it provides various courses.

In a conventional combo washing machine, when a user wishes to perform drying as well as washing of clothes, the user has to inconveniently select a drying option after implementation of a washing course ends. Of course, to enable automated implementation of washing and drying, a washing course and a drying option may be selected together to cause sequential implementation of washing and drying. However, in this case, there is a great amount of information to be input by the user, which causes difficult and inconvenient use.

Meanwhile, the conventional combo washing machine causes seriously wrinkled laundry when washing and drying are completed or when only drying is completed. Therefore, to remove wrinkles and odor remaining on dried clothes, it is necessary to additionally select a refreshing option to refresh the clothes. That is, many selections including selection of a washing course, selection of a drying option and selection of a refreshing option are required.

For example, a dress shirt that is worn one time may be saturated with slight pollution and odor. In addition, the dress shirt may be wrinkled. In recent years, a refreshing course or option to refresh, e.g., a shirt that is worn one time using steam, hot air or cold air may be used without washing of the shirt. However, using only the refreshing course causes limited washing effects.

In addition, clothes formed of an easily damageable delicate material, such as a dress shirt, have a high risk of damage and may confuse the user when refreshing is additionally performed after completion of washing and drying.

To prevent damage to the clothes as described above, the user has to inconveniently adjust some options, such as a temperature of wash water and a temperature of hot air upon each of a washing course step, a drying step and a refreshing step.

In addition, an ordinary user has difficulty in knowing a reference value to balance removal of wrinkles with a drying degree, which makes it impossible to effectively remove wrinkles or causes the user to be unable to wear clothes because the clothes are not yet dried.

SUMMARY

An innovative aspect of the subject matter described in this specification may be embodied in an operating method of a laundry machine, the laundry machine including a tub configured to receive wash water; a drum that is configured to rotate in the tub and to receive clothes; a control panel configured to receive input from a user; a course selection part located on the control panel and configured to enable user selection of an operating course from a plurality of operating courses; and one or more option selection parts located on the control panel and configured to enable user selection of one or more options for the operating course selected by the user, the operating method including selecting a specific course in response to an operating course selection signal generated based on user input received via the course selection part; and based on selection of the specific course and regardless of a selection of the one or more options, controlling sequential performance of the following operations: cleaning the clothes by supplying wash water to the drum and washing the clothes; drying the clothes by supplying hot air to the drum; and refreshing the clothes by supplying steam to the drum.

These and other embodiments can each optionally include one or more of the following features. The plurality of operating courses includes a steam usable course that enables a steam cycle for supplying steam to the drum, a steam course that includes the steam cycle, and a steam omission course that omits the steam cycle. The specific course includes the steam course. The cleaning includes washing the clothes using detergent and wash water and rotating the drum; rinsing the clothes using newly supplied wash water and rotating the drum after draining the detergent and the wash water; and dehydrating the clothes using centrifugal force by rotating the drum at high speed. The selecting, the washing, the rinsing, the dehydrating, the drying, and the refreshing are sequentially performed based on the selected specific course.

The one or more option selection parts include an option selection part associated with the washing, an option selection part associated with the rinsing, an option selection part associated with the dehydrating, and an option selection part associated with the drying. The option selection part associated with the washing includes a steam selection part, a wash water temperature selection part, and a washing degree selection part. A selection of the option selection part associated with the washing is limited based on the selected specific course. The steam selection part is deactivated based on the selected specific course. The option selection part associated with the rinsing includes a rinsing frequency selection part. The rinsing frequency selection part is deactivated based on the selected specific course. The option selection part associated with the dehydrating includes a dehydration rotation speed selection part.

The selection of the option selection part associated with the dehydrating is limited based on the selected specific course. The option selection part associated with the drying includes a hot air temperature selection part and a drying degree selection part. A selection of the option selection part associated with the drying is limited based on the selected specific course. A selection of the option selection part is limited based on the selected specific course. The actions further include setting, based on the selected specific course, a temperature of wash water to a predetermined value of about 40 degrees Celsius and an operating rate of a motor (motor driving time/total time) to a predetermined value of about 1/3 in the washing, and limiting change of the temperature of the wash water and the operating rate of the motor.

The actions further include setting, based on the selected specific course, a dehydration RPM to a predetermined value of about 600 in the dehydrating, and limiting change of the dehydration RPM. The actions further include setting, based on the selected specific course, a temperature of hot air to a predetermined value of about 45 degrees Celsius and an operating rate of a motor to a predetermined value of 1/16 in the drying, and limiting change of the temperature of the hot air and the operating rate of the motor values. The refreshing further includes re-drying the clothes by resupplying hot air to the drum after supplying the steam. The actions further include setting, based on the selected specific course, a temperature of wash water and an operating rate of a motor during the cleaning to each have predetermined values and limiting changes of the temperature of the wash water and the operating rate of the motor during the cleaning, and setting a temperature of hot air and an operating rate of the motor during the drying to each have predetermined values and limiting changes of the temperature of the hot air and the operating rate of the motor during the drying.

A wrinkle removal score is 3.5 or more for two or three dress shirts after the cleaning, the drying, and the refreshing of the two or three dress shirts. The actions further include dehydrating the clothes using centrifugal force by rotating the drum at high speed, the dehydrating being between the cleaning and the drying, and performing, based on the selected specific course, the cleaning and the dehydrating for about 32 minutes, the drying for about 20 to 25 minutes, and the refreshing for about 25 minutes. After an end of the specific course, a wrinkle removal score of two or three dress shirts is 3.5 or more and the percentage of water is 5% or less.

Another innovative aspect of the subject matter described in this specification may be embodied in a laundry machine, the laundry machine including a tub configured to receive wash water; a drum that is configured to rotate in the tub and to receive clothes; a control panel configured to receive input from a user; a course selection part located on the control panel and configured to enable user selection of an operating course from a plurality of operating courses; an option selection part located on the control panel and configured to enable user selection of an option associated with at least one of washing, rinsing, dehydrating, and drying based on the selected operating course; and a controller configured to (i) control operation of the laundry machine based on the selected operating course and the selected option and (ii) based on a specific course for the washing, the drying, and refreshing using steam is received through the course selection part, control operation of the laundry machine such that selection through the option selection part is limited and the specific course is performed based on a predetermined program.

DETAILED DESCRIPTION

Figure 1:
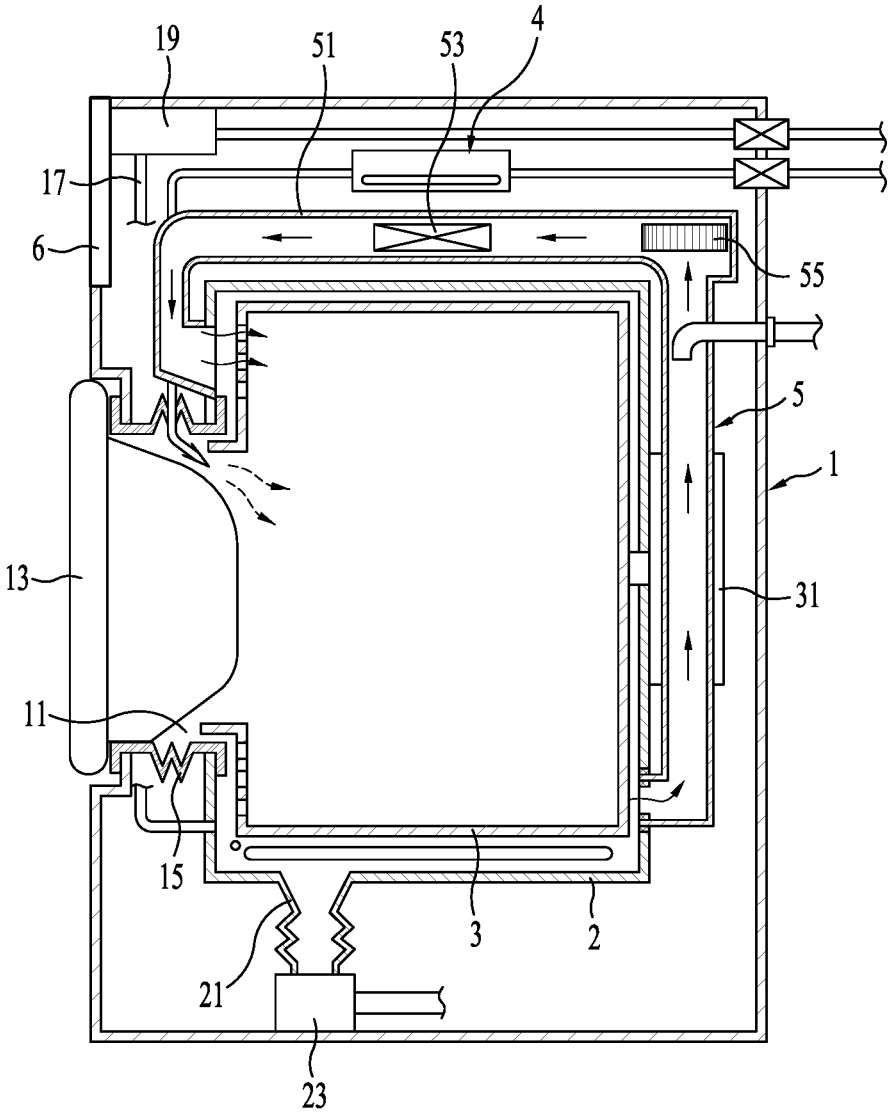
FIG. 1 is a perspective view of an example laundry machine.

FIG. 1 is a perspective view of an example laundry machine.

The laundry machine includes a main body 1, a tub 2, a drum 3, a steam generating device 4, and an air supply device 5.

The main body 1 forms an external appearance of the laundry machine and has an input opening 11 perforated in a front surface thereof. In this case, a door 13 to open or close the input opening 11 is coupled to a region of the main body 1 around the inlet opening 11. A gasket 15 is attached to an inner periphery of the input opening 11 to form a hermetic seal between the door 13 and the input opening 11

In addition, a wash water supply pipe 17 is mounted in the main body 1 to supply wash water into the tub 2.

In some implementations, a detergent box 19 may be mounted in the main body 1, and the wash water supply pipe 17 may be connected to the tub 2 by way of the detergent box 19 so as to communicate with the interior of the tub 2.

The tub 2 is placed in the main body 1 and supported by internal support components. The tub 2 is provided at a lower end thereof with a drain passage 21 for drainage of wash water.

A drain pump 23 is located in the drain passage 21 and driven to forcibly drain wash water.

The drum 3 is rotatably installed in the tub 2 such that an opening of the drum 3 faces the input opening 11 of the main body 1.

In some implementations, a drive unit 31 to rotate the drum 3 may be coupled to the back of the drum 3. The drive unit 31 may be a motor. As such, the drum 3 may be rotated by rotation of the motor.

The steam generating device 4 is configured to supply a prescribed amount of steam into the drum 3 (or the tub 2).

The air supply device 5 is used to dry clothes and configured to supply hot air or cold air into the drum 3.

The air supply device 5 may be comprised of an air duct 51, a drying heater 53 and a blowing fan 55.

The drying heater 53 may be located in the air duct 51 and configured to generate hot air by heating air moving in the air duct 51.

The blowing fan 55 may also be located in the air duct 51 and configured to blow air such that the air in the air duct 51 is supplied into the drum 3 after passing through the drying heater 53.

In some implementations, a control panel 6 is installed to the main body 1 and serves as a user interface. The control panel 6 may be attached to the front surface of the main body 1 at a position above the input opening 11.

Figure 2:
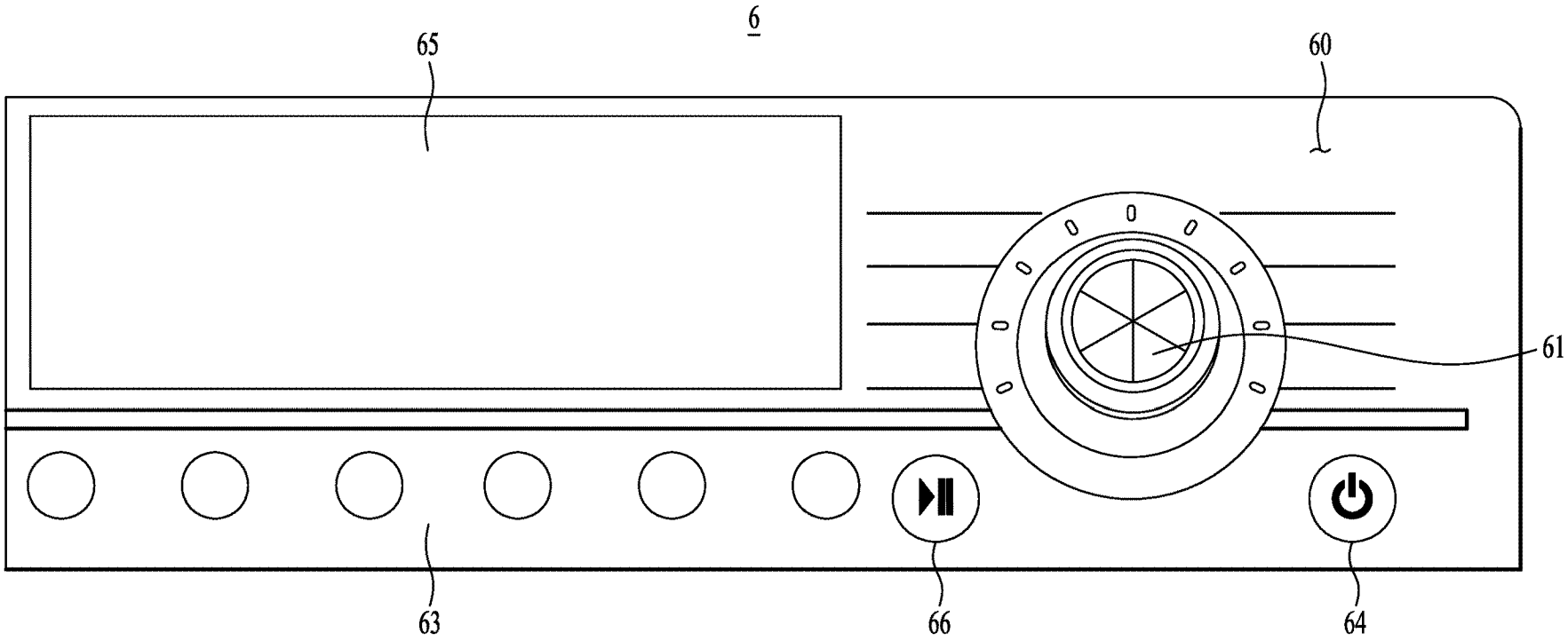
FIG. 2 is a schematic view of an example control panel.

FIG. 2 is a is a schematic view of an example control panel 6.

The control panel 6 may include a course selection part 61, one or more option selection parts 63 and a display part 65. In addition, the control panel 6 may further include a power input part 64 and a start/pause input part 66.

The course selection part 61 is provided to assist a user in selecting any one operating course among a plurality of operating courses. A detailed description related to the selectable operating courses will follow. Here, the operating courses may refer to courses programmed to include a plurality of cycles or strokes. That is, the operating courses may refer to courses previously programmed according to clothes treatment purposes. A general washing course includes washing, rinsing and dehydration cycles. Upon selection of the washing course, the laundry machine is operated in a predetermined sequence of washing, rinsing and dehydration to complete clothes treatment.

The option selection parts 63 are provided to assist the user in selecting options based on an operating course selected via the course selection part 61.

The option selection parts 63 are additionally selected by the user as needed and, therefore, an operating method may be performed regardless of selection of the option selection parts 63.

A detailed description related to options included in the option selection parts 63 will follow.

The display part 65 may indicate an operating course or options selected by the user and also indicate a residual time or current state of progress for user notification.

The user first operates the power input part 64 to apply power to the laundry machine. Then, the user selects a specific operating course via the course selection part 61 and selects the start/pause input part 66. In addition to the specific operating course, various options may be selected via the option selection parts 63.

Once the start/pause input part 66 is operated, the laundry machine starts and ends an operation based on the input operating course and the input options.

Figure 3:
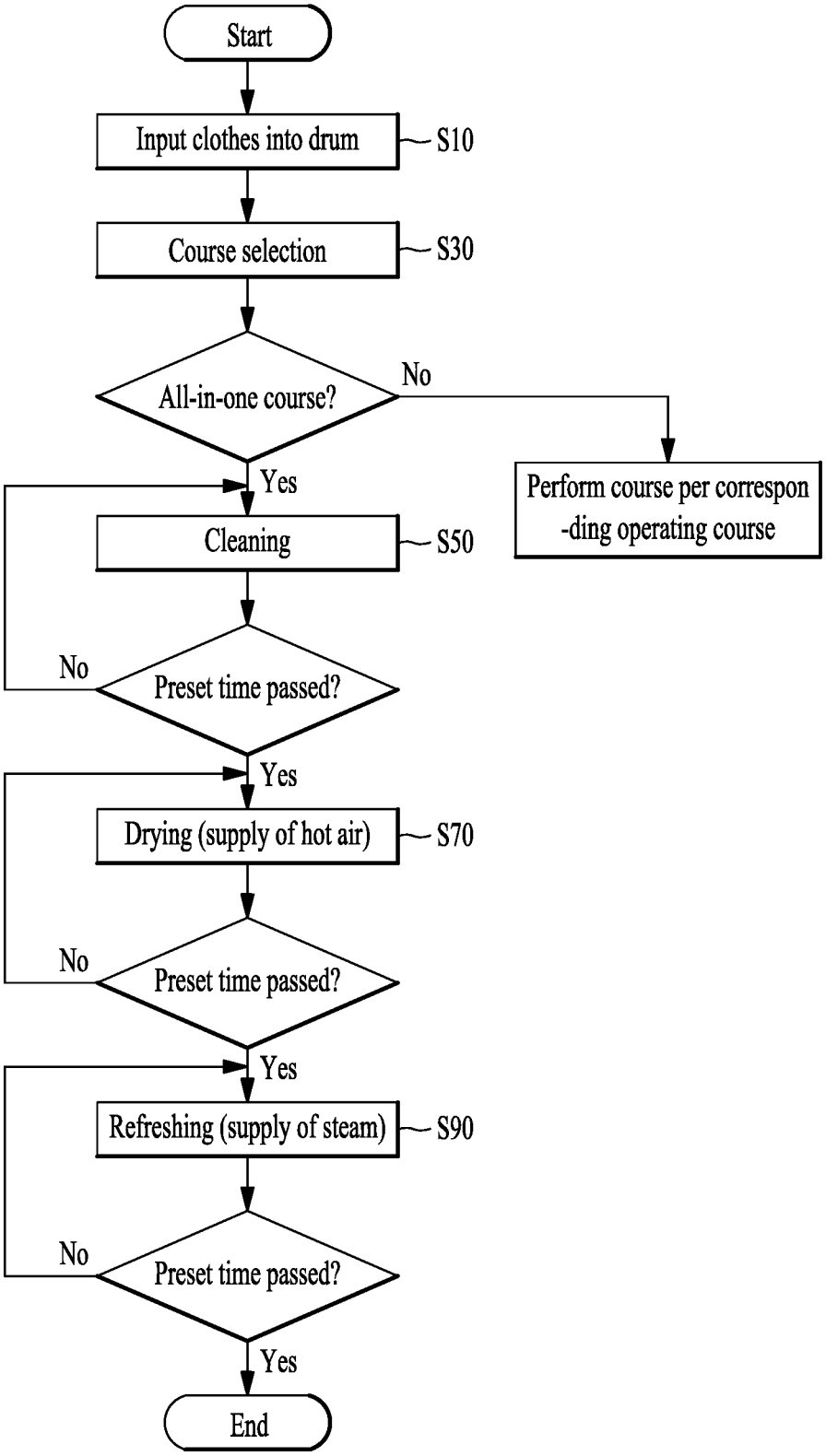
FIGS. 3-5 are flowcharts of example operating methods for a laundry machine.

FIG. 3 is a flowchart of an example operating method for a laundry machine.

Hereinafter, the operating method for the above-described laundry machine will be described with reference to FIG. 3.

The laundry machine and washing method may provide automated implementation of a specific course including washing, drying and refreshing as well as a general washing course. That is, in some implementations a laundry machine and a washing method provide rapid treatment of clothes that have a high risk of damage and a high frequency of wearing, such as dress shirts, thereby allowing the user to wear the clothes immediately after completion of treatment.

First, the user inputs clothes that require washing, drying and wrinkle removal into the drum 3 (S10). This input of clothes may be performed before or after power is applied to the laundry machine. Once the input of clothes has been completed, the user closes the door and operates the control panel for clothes treatment.

When the user selects a desired course among a plurality of operating courses, a controller 60 undergoes a course selection step of receiving an operating course selection signal via the course selection part 61 (S30).

In the case in which the user wishes to perform washing, drying and wrinkle or odor removal at once, the user may select a specific operating course (hereinafter referred to as "all-in-one course"). The all-in-one course is a single course of performing at least three clothes treatment functions including washing, drying and refreshing. That is, the laundry machine and washing method may provide such an all-in-one course and automated treatment of clothes by the laundry machine based on the all-in-one course.

In some implementations, the laundry machine is operated in an operating method corresponding to a course selected by the user, i.e., according to whether the user selects an all-in-one course or any one of other courses.

Upon selection of the all-in-one course among the operating courses in the course selection step S30, first, a cleaning step is performed (S50).

In the cleaning step S50, the controller supplies water received in the tub 2 into the drum 3 and, along with the wash water, also supplies detergent received in the detergent box 19 into the drum 3. That is, the cleaning step S50 may be a step of removing contaminants from clothes using detergent and wash water while driving the drum 3.

The controller controls the drum drive unit 31 to rotate the drum 3. Thereby, as the clothes are rotated in the drum 3 along with the wash water and the detergent, spots, impurities or the like are removed from the clothes.

The cleaning step S50 may be a general washing step, and may include a rinsing step and a dehydration step.

In the washing step, contaminants are removed from clothes using wash water and detergent during driving of the drum. Thus, the contaminants removed in the washing step may be understood as being dissolved in wash water or transferred to wash water. The wash water is drained after the washing step. That is, the washing step may include driving of the drum and drainage of wash water after completion of driving of the drum.

Thereafter, new wash water is supplied without detergent. Then, a procedure of transferring the detergent and the contaminants remaining on the clothes to the wash water while driving the drum is performed. This may be referred to as the rinsing step. The wash water is drained after the rinsing step. That is, the rinsing step may include driving of the drum and drainage of wash water after completion of driving of the drum.

Thereafter, the drum is rotated to remove moisture from the clothes using centrifugal force. This may be referred to as the dehydration step.

Accordingly, the cleaning step S50 may be a step of performing a series of the washing step, the rinsing step and the dehydration step.

A drying step is performed after end of the cleaning step S50 (S70).

In the drying step S70, the controller controls driving of the air supply device 5 to supply hot air to the clothes in the drum 3.

In addition, the controller controls the drum drive unit 31 to rotate the drum 3. Through driving of the drum 3, hot air is evenly supplied to the clothes and the clothes, which are wet due to the moisture absorbed in the washing step, are dried. That is, the moisture remaining after the dehydration step may be removed by the hot air.

In addition, in the drying step S70, laundry is repeatedly lifted and dropped through driving of the drum 3 and, simultaneously, hot air is supplied to the laundry. As such, particles, such as dust and the like, contained in the laundry may be separated from the laundry. This enables easy removal of dust and the like containing various bacteria.

A refreshing step S90 is performed after end of the drying step S70.

In the refreshing step S90, the controller supplies steam into the drum 3. One method of supplying steam may be steam injection. Steam injection may achieve the effect of evenly supplying steam to the laundry. Of course, a steam supply method is not limited thereto. In addition, the drum 3 is may be driven during the refreshing step.

In the refreshing step S90, non-volatile odor particles not removed in the above-described cleaning step S50 and drying step S70 may be removed. That is, steam is supplied to the laundry, more particularly, odor particles contained in the laundry, thereby dissolving the odor particles. This causes the non-volatile odor particles to be easily removable.

Meanwhile, the steam serves to relieve or remove wrinkles of the laundry by deeply permeating the laundry. That is, as the steam permeates between finely entangled wrinkled meshes, wrinkles are relieved or removed.

In the refreshing step S90, steam supply may be controlled to prevent supply of an excessive amount of steam. That is, since an excessive amount of steam causes the steam to be changed into water due to temperature drop, thus resulting in unwanted wetting of the laundry, considerable consumption of time and energy for re-drying may be needed. Therefore, it is necessary to appropriately control the supply amount of steam.

One method of controlling the supply amount of steam is to check an increase in the interior temperature of the drum or the tub due to steam. Thus, since an excessive temperature increase means supply of an excessive amount of steam, the supply amount of steam may be controlled by checking the temperature increase. Of course, the supply amount of steam may be controlled by checking an injection time of steam that is continuously injected. That is, since the injection amount of steam per hour is given, the supply amount of steam may be appropriately controlled by setting a steam injection time.

Another method of controlling the supply amount of steam is to check the amount of water supplied for steam generation.

As the refreshing step S90 ends, operation of the laundry machine based on the selected all-in-one course ends.

That is, when the all-in-one course is selected (S30), the cleaning step S50 is first performed and, after end of the cleaning step S50, the drying step S70 is sequentially performed even if the user does not additionally select a drying option.

In addition, even if the user does not additionally select a refreshing course after selecting the all-in-one course, the refreshing step S90 is performed sequentially after end of the drying step S70.

That is, as the cleaning step S50, the drying step S70 and the refreshing step S90 are sequentially performed via selection of a single course, i.e., the all-in-one course (S30), clothes, from which wrinkles and odor as well as impurities and spots have been removed, may be provided to the user. In other words, the laundry machine may treat clothes to allow the user to wear the clothes immediately after completion of the course.

In this way, the user who retrieves the clothes from the drum 3 after end of the all-in-one course may wear the clothes without an additional procedure, which may eliminate additional treatment time and cost and provide user convenience.

Meanwhile, the cleaning step S50 may be a step of removing contaminants using only wash water without detergent. In this case, reduction of contaminant removal efficiency as compared to the case of using detergent is inevitable. However, washing using only water may cause greater wrinkle removal efficiency or odor removal efficiency than that in the case of performing only refreshing. In addition, the rinsing step may be omitted because washing is performed using only wash water without detergent. This may reduce a course implementation time. As such, in some implementations, the cleaning step S50 is a washing step using only wash water without detergent. Of course, the cleaning step may be a step including all of the washing step using both wash water and detergent, the rinsing step and the dehydration step as described above.

In addition, when the all-in-one course is selected in the course selection step S30, the aforementioned respective sub-steps are performed based on predetermined values and, therefore, may not be affected by options selected via the option selection parts 63.

That is, the cleaning step S50, the drying step S70 and the refreshing step S90 are sequentially performed and ended based on predetermined values regardless of options selected via the option selection parts 63. This will be described below in detail.

Figure 4:
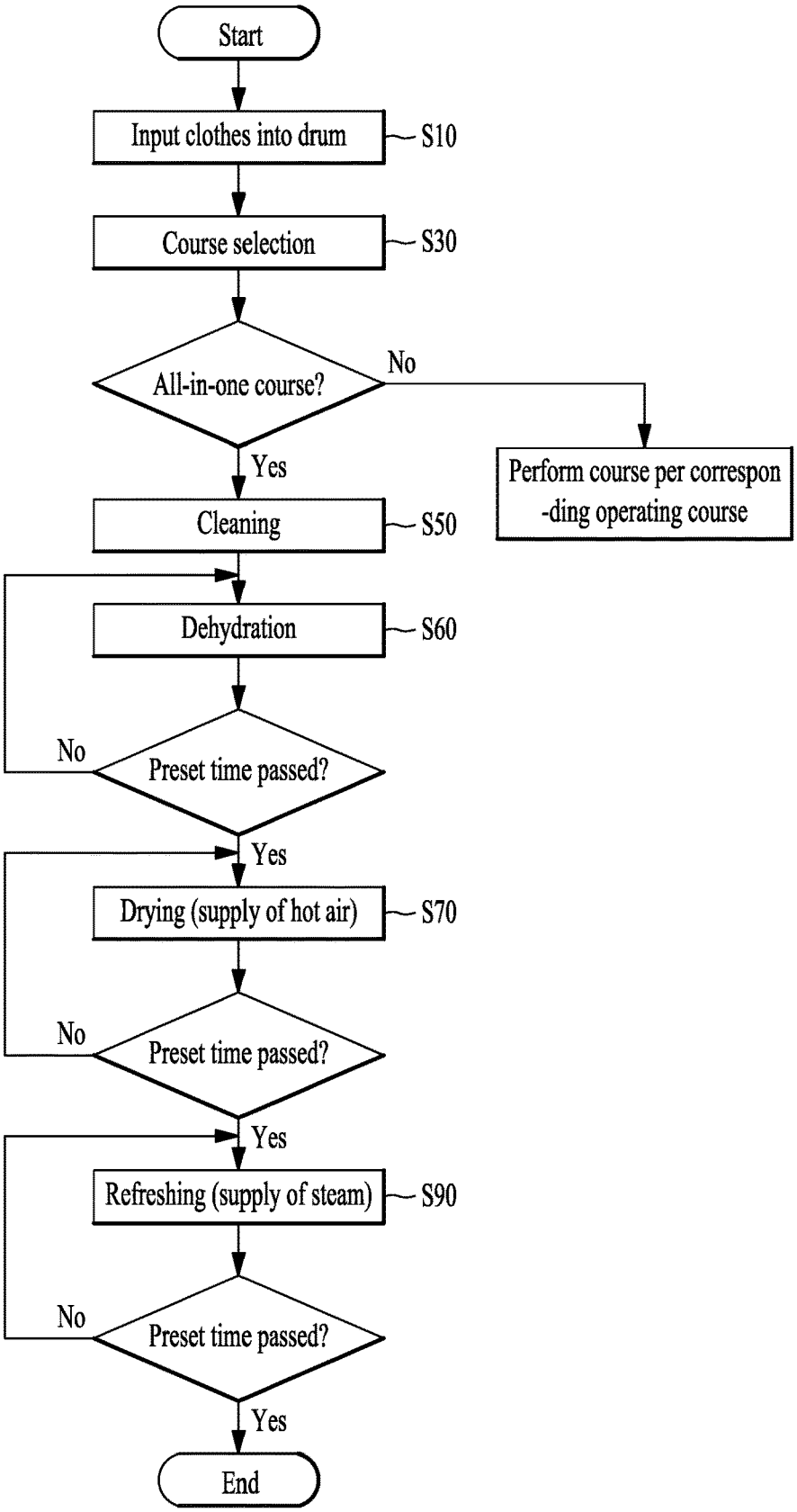

FIG. 4 is a flowchart of an example operating method for the laundry machine.

Upon selection of the all-in-one course (S30), the operating method for the laundry machine may further include a dehydration step S60 after end of the cleaning step S50 and before implementation of the drying step S70.

Most clothes in the drum are wet due to a great amount of absorbed water after end of the cleaning step S50 using wash water. When the drying step S70 is directly performed on the wet clothes, drying efficiency may be low and a great amount of time may be needed to completely dry the clothes.

Therefore, the operating method may further include the dehydration step S60 after the cleaning step S50 ends and before the drying step S70 is performed.

In the dehydration step S60, the controller drives the drum drive unit 31 to rotate the drum 3 at high speeds so as to dehydrate the clothes by centrifugal force.

After the dehydration step S60 ends, the clothes, from which the absorbed moisture has been discharged to some extent by the dehydration step S60, are subjected to the drying step S70, which allows the moisture, not yet removed in the dehydration step S60, to be completely removed by hot air. As a result of performing the dehydration step S60 immediately before the drying step S70, an overall time required to completely remove the moisture from the clothes may be reduced.

In some implementations, when the user selects the all-in-one course in the course selection step (S30), the cleaning step S50 is first performed and, sequentially, after end of the cleaning step S50, the dehydration step S60 may be performed.

After end of the dehydration step S60, the drying step S70 is performed regardless of selection of options. After end of the drying step S70, sequentially, the refreshing step S90 is performed regardless of whether or not the user further selects a refreshing course. As the refreshing step S90 ends, operation of the laundry machine based on the all-in-one course ends.

Hereinafter, for convenience of description, assume that the operating method for the laundry machine based on the all-in-one course includes the dehydration step S60.

Figure 5:
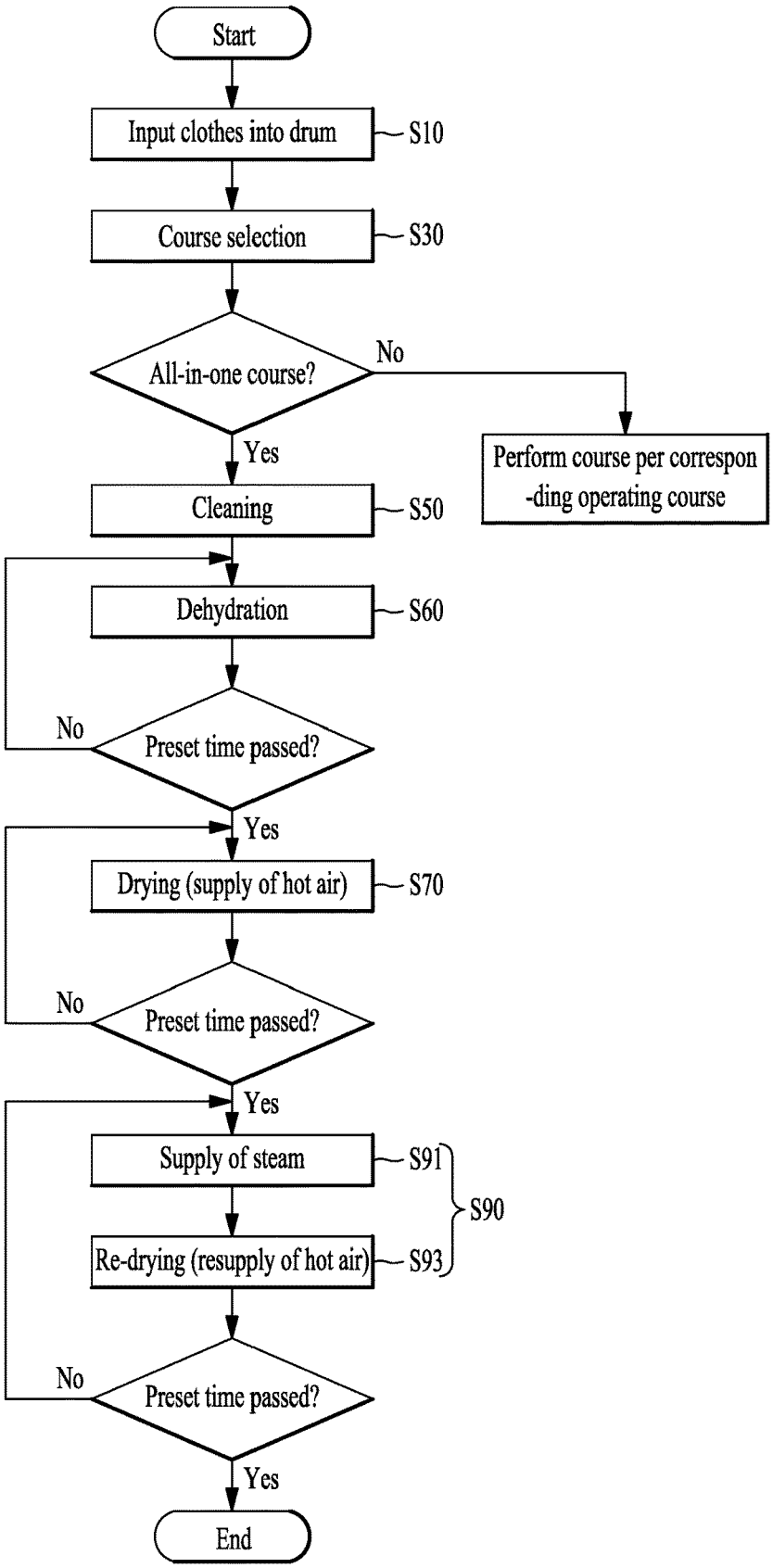

FIG. 5 is a flowchart of an example operating method for the laundry machine.

As shown in FIG. 5, the refreshing step S90 may include a re-drying step S93.

That is, the refreshing step S90 may include supplying steam (S91) and, thereafter, resupplying hot air into the drum (S93) to dry clothes or laundry.

Since there is a risk of the steam supply step S91 causing the laundry to be again wet, the re-drying step S93 may be included in the refreshing step S90 to allow the user to retrieve and wear the laundry immediately after the all-in-one course ends.

Figure 6:
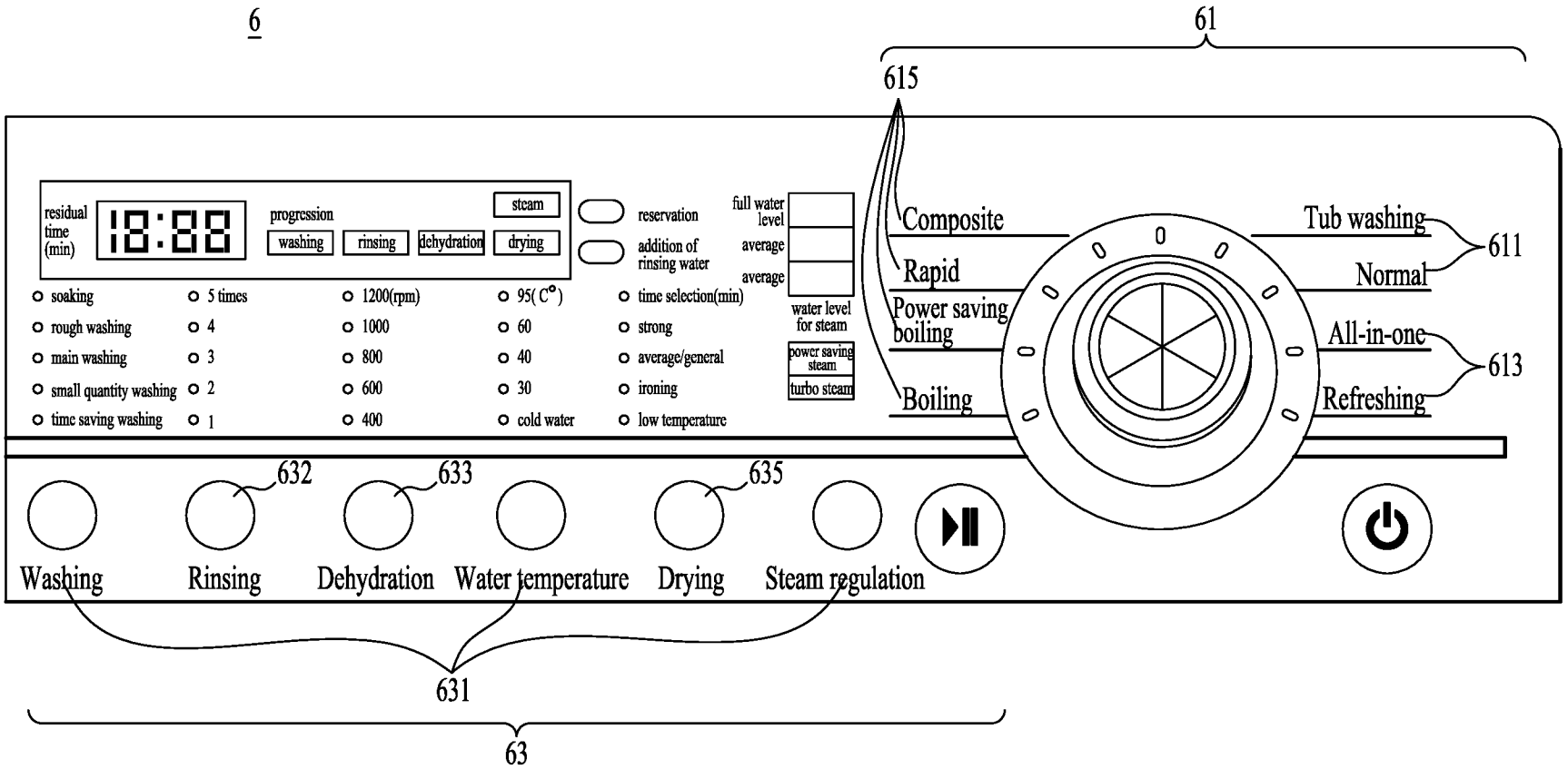
FIG. 6 illustrates an example control panel.

FIG. 6 illustrates an example control panel 6.

As described above, the control panel 6 includes the course selection part 61 to assist the user in selecting any one operating course among a plurality of operating courses.

As shown in the drawing, the operating courses may include composite, rapid, power saving boiling, boiling, normal, tub washing, refreshing, all-in-one courses and the like. In some implementations, these operating courses are related to the course selection part, without being limited thereto.

In addition, although the drawing shows the course selection part 61 as having a rotary knob shape, the shape of the course selection part is not limited thereto.

The operating courses may be divided into steam usable courses 611, steam courses 613 and steam omission courses 615 according to whether or not steam is supplied.

The steam usable courses 611 are courses in which steam may be supplied or may not be supplied according to user intention. That is, in the steam usable courses, the user may operate the laundry machine by supplying steam when the user wishes to remove wrinkles or odor of clothes or laundry or by not supplying steam when the user wishes rapid washing or does not require removal of wrinkles or odor.

The steam usable courses 611 may include the normal course and the tub washing course, for example.

Meanwhile, the steam courses 613 are courses in which steam is unconditionally supplied regardless of user intention. That is, when a course selected by the user has a purpose of removing wrinkles or odor, steam is supplied regardless of whether or not the user wishes to supply steam.

Accordingly, when the user selects the steam courses 613, supply of steam cannot be omitted during operation of the laundry machine even if the user does not wish to supply steam. The steam courses 613 may include the refreshing course in which steam is always supplied, for example.

On the other hand, the steam omission courses 615 are courses in which steam is not supplied regardless of user intention. That is, in the case of a washing course having no purpose of removing wrinkles or odor or a course requiring implementation thereof within a short time, supply of steam is omitted regardless of whether or not the user wishes to supply steam.

Accordingly, when the user selects the steam omission courses 615, steam cannot be supplied during operation of the laundry machine even if the user wishes to supply steam. The steam omission courses 615 may include the composite course, the rapid course, the power saving boiling course, the boiling course and a bedding course, for example.

The course selection part 61 included in the control panel 6 may be indicated such that the respective courses are differently indicated according to whether or not steam is supplied, for easy user discrimination.

One method for discrimination of the course selection part 61 is to indicate the steam usable courses 611, the steam courses 613 and the steam omission courses 615 by different colors. As the courses displayed on the control panel 6 are indicated by different colors according to whether or not steam is supplied, it is possible to allow the user to easily discriminate between and select the courses.

The all-in-one course, which is an operating course, requires sequential implementation of the cleaning step S50, the dehydration step S60, the drying step S70 and the refreshing step S90 and, therefore, the operating method essentially includes a steam supply step corresponding to the refreshing step S90.

Accordingly, in some implementations, the all-in-one course is included in the steam course 613 in which steam is always supplied regardless of user intention.

Meanwhile, as described above, in addition to the course selection part 61, the control panel 6 may include the option selection parts 63 for selection of a plurality of options to assist the user in selecting options based on an operating course selected by the course selection part 61.

The option selection parts 63 may include options that the user may additionally select after selecting an operating course.

As shown in FIG. 6, the option selection parts may include a washing degree selection part, a rinsing frequency selection part, a dehydration RPM selection part, a wash water temperature selection part, a drying temperature selection part and the like, without being limited thereto.

The option selection parts 63 may be divided according to option implementation steps. That is, the option selection parts 63 may be divided into option selection parts 631 associated with the washing step, an option selection part 632 associated with the rinsing step, an option selection part 633 associated with the dehydration step and an option selection part 635 associated with the drying step.

In some implementations, the laundry machine includes any one of the option selection parts 631 associated with the washing step, the option selection part 632 associated with the drying step, the option selection part 633 associated with the dehydration step and the option selection part 635 associated with the drying step, or may include two or more ones of the aforementioned option selection parts.

The option selection parts 631 associated with the washing step may be provided to assist the user in selecting one or more options upon implementation of the cleaning step S50 by the laundry machine. In particular, the option selection parts 631 may be used to select an option in the washing step using wash water.

That is, the option selection parts 631 associated with the washing step may include at least one of a steam selection part, a wash water temperature selection part and a washing degree selection part. Of course, in addition to the aforementioned option selection parts, any one of other option selection parts associated with the washing step may be included. In this case, an option associated with each option selection part may include a plurality of conditions and the option selection part may be used to select any one of the conditions.

For example, the washing degree selection part may be used to select a plurality of washing degrees based on a contamination degree. FIG. 6 shows selection of any one of soaking, rough washing, main washing, small quantity washing and time saving washing.

The steam selection part relates to an option to select whether or not to supply steam to clothes in the cleaning step S50. The wash water temperature selection part relates to an option to select a temperature of wash water in consideration of a contamination degree of laundry, delicateness of laundry and the like.

In addition, the rinsing frequency selection part may relate to an option to select the frequency of rinsing in consideration of a contamination degree of laundry, delicateness of laundry and the like. FIG. 6 shows an example in which the frequency of rinsing is selected from one time to five times. The frequency of rinsing means the number of repeating a series of procedures of inputting wash water without detergent and draining the wash water after implementation of rinsing.

In some implementations, selection of the option selection part 631 associated with the washing step is limited when the all-in-one is selected by the user.

Limited option selection may mean that, even if the user habitually and unconsciously selects an option or makes a selection mistake due to ignorance about a use method, the selected option is not reflected in a washing course under control of the controller.

In addition, limited option selection may mean that, when the user selects an option associated with, e.g., the washing step, selection impossibility of the corresponding option is notified to the user via an alarm sound. In addition, limited option selection may mean deactivation of an option selection part to make it impossible for the user to select a corresponding option, or may mean that the controller ignores selection even if the selection is possible.

The limited option selection serves to prevent meaningless change of an optimally programmed all-in-one course. That is, this serves to prevent meaningless change of a program optimized with regard to an implementation time, a contamination removal degree, a wrinkle removal degree and a clothes damage degree.

The all-in-one course is an operating method in which the cleaning step S50, the dehydration step S60, the drying step S70 and the refreshing step S90 are sequentially performed in a single procedure, and the cleaning step S50 may be performed based on predetermined reference values with regard to whether or not to supply steam, a steam supply degree, the frequency of rinsing, a temperature of wash water and a washing degree.

This is because, in the cleaning step S50 performed by selection of the all-in-one course, reference values optimized to achieve removal of wrinkles and enhanced dryness in consideration of the overall procedure are already set and, therefore, the user may be prevented from selecting options associated with the cleaning step.

That is, when options related to whether or not to supply steam, a steam supply degree, the frequency of rinsing, a temperature of wash water and a washing degree are selected by the user, this may cause a problem of insufficient removal of wrinkles from laundry or insufficiently dried laundry.

Therefore, in some implementations, upon selection of the all-in-one course, it is possible to prevent the user from selecting options associated with the cleaning step.

More particularly, upon selection of the all-in-one course, it is possible to deactivate the steam selection part among the option selection parts such that the user cannot select the steam selection part.

Deactivation of selection means that the user selection is impossible in principle. One method of deactivating selection causes the steam selection part in the form of a button to be not pushed.

The all-in-one course, as described above, corresponds to the steam course 613 in which steam is always supplied regardless of user intention. Accordingly, selection of the steam selection part is unnecessary and, therefore, the steam selection part may be deactivated so as not to be selected.

The option selection part 633 associated with the dehydration step relates to an option which may be selectively provided upon implementation of the dehydration step S60 by the laundry machine.

That is, the option selection part 633 associated with the dehydration step may include a dehydration RPM selection part and, of course, include any one of other options associated with the dehydration step.

The dehydration RPM selection part relates to an option to allow the user to select revolutions per minute (RPM) of the drum while the drum is rotated for 1 minute upon the dehydration step S60. The user may select a dehydration RPM in consideration of a contamination degree of laundry or delicateness of laundry.

Note that it is possible to limit selection of the option selection part 633 associated with the dehydration step when the all-in-one course is selected by the user.

Since the all-in-one course has reference values already optimally set to achieve removal of wrinkles and enhanced dryness in consideration of the overall procedure as described above, selection of the option selection part 633 associated with the dehydration step may be limited.

That is, when a dehydration RPM option is freely selectable by the user, laundry may be excessively wrinkled upon selection of a high dehydration RPM.

Accordingly, upon selection of the all-in-one course, selection of the option selection part 633 associated with the dehydration step may be limited to achieve a purpose of wrinkle removal.

The option selection part 635 associated with the drying step relates to an option that may be selectively provided upon implementation of the drying step S70 by the laundry machine.

More specifically, the option selection part 635 associated with the drying step may include at least one of a hot air temperature selection part and a drying degree selection part and, of course, may include any one of other option selection parts associated with the drying step.

The hot air temperature selection part, although not shown in the drawing, relates to an option to allow the user to select a temperature of hot air supplied for drying of laundry in the drying step S70. The user may select a temperature of hot air in consideration of a desired drying degree of laundry, delicateness of laundry and the like.

The drying degree selection part, as exemplarily shown in the drawing, may allow the user to select any one of strong, average and ironing options based on user intention.

Note that it is possible to limit selection of the option selection part 635 associated with the drying step when the all-in-one course is selected by the user.

Since the all-in-one course has reference values already optimally set to achieve removal of wrinkles and enhanced dryness in consideration of the overall procedure as described above, selection of the option selection part 635 associated with the drying step may be limited.

That is, when the user selects an excessively high temperature of hot air in order to increase a drying degree, there is a risk of damaging delicate clothes. Conversely, when the user selects an excessively low temperature of hot air in order to prevent damage to clothes, there is a risk of insufficient drying of clothes.

Accordingly, upon selection of the all-in-one course, selection of the option selection part 635 associated with the drying step may be limited to achieve a desired purpose of sufficient drying of clothes without damage to the clothes.

In addition to limiting selection of each of the option selection part 631 associated with the washing step, the option selection part 633 associated with the dehydration step and the option selection part 635 associated with the drying step as described above, in some implementations, selection of all of the option selection parts 63 may be limited.

Upon selection of the all-in-one course, since all reference values related to options of the washing step, the dehydration step and the drying step are determined in consideration of prevention of damage to laundry, removal of wrinkles of laundry and dryness of laundry, it is possible to limit selection of all of the option selection parts 63.

Hereinafter, one implementations of predetermined reference values related to options of each step, which are provided to prevent damage to laundry, to remove wrinkles of laundry and to optimize dryness of laundry upon selection of the all-in-one course, will be described.

Of course, note that these reference values are values optimized to achieve desired purposes of the all-in-one course without being limited thereto, and other predetermined reference values may be used.

In some implementations, when the all-in-one course is selected, wash water having a limited temperature of about 40 degrees Celsius may be supplied in the cleaning step S50. This serves to prevent damage to delicate laundry using such a lower temperature of wash water than that in the case in which the washing step is performed alone.

In addition, although not an option included in the above-described option selection parts, an actual operating rate of the motor in the cleaning step S50 may be set to a limited value of about 1/3.

The actual operating rate of the motor may be a ratio of a total time to a time for which the motor is driven and may be represented by a motor driving time/total time. That is, a higher actual operating rate of the motor means a longer motor driving time.

That is, that the actual operating rate of the motor is about 1/3 means that assuming that total time is 3, the motor is driven for a time of 1.

The actual operating rate of the motor in the cleaning step S50 according to the all-in-one course is less than that in a usual case in which the washing step is performed alone, thus serving to prevent damage to delicate laundry and generation of excessive wrinkles in laundry.

In the cleaning step S50 as described above a temperature of wash water or an actual operating rate of the motor has a predetermined reference value and change of the predetermined reference value by the user is limited.

In the dehydration step S60 as described above, a dehydration RPM value may have a predetermined reference value of about 600 RPM. This value means 600 rotations per minute and is less than a dehydration RPM value of a usual dehydration step that is performed alone, which may prevent damage to delicate laundry and generation of excessive wrinkles in laundry.

In the dehydration step S60 as described above a dehydration RPM value has a predetermined reference value and change of the predetermined reference value by the user is limited.

In the drying step S70, a temperature of hot air to be supplied may be limited to about 45 degrees Celsius, which may prevent damage to delicate laundry and generation of excessive wrinkles in laundry.

In addition, an actual operating rate of the motor in the drying step S70 may be set to a limited value of about 1/16. The meaning of the actual operating rate of the motor has been described above and that the actual operating rate of the motor is about 1/16 means that assuming that total time is 16, the motor is driven for a time of 1.

The actual operating rate of the motor in the drying step S70 according to the all-in-one course is less than that in a usual case in which a drying step is performed alone, which may prevent damage to delicate laundry and generation of excessive wrinkles in laundry.

In the drying step S70 as described above, a temperature of hot air or an actual operating rate of the motor has a predetermined reference value and change of the predetermined reference value by the user is limited.

As described above, the laundry machine provides the user with clothes having high dryness and washing degrees and no wrinkles as the user selects a single course. In addition, even with regard to delicate clothes that are greatly affected by a temperature of wash water, dehydration RPM or the like, the laundry machine allows the user to attain desired effects while preventing damage to the clothes.

The user may input two or three dress shirts, which are usually formed of delicate materials and require careful management, into the drum and then select the all-in-one course (S30).

In this case, upon selection of the all-in-one course, the cleaning step S50, the dehydration step S60, the drying step S70 and the refreshing step S90 are sequentially performed. The all-in-one course ends simultaneously with end of the refreshing step S90.

In particular, in order to prevent damage to clothes, as described above, a temperature of wash water and an actual operating rate of the motor in the cleaning step S50 and a temperature of hot air and an actual operating rate of the motor in the drying step S70 remain at predetermined values without change.

In this case, in some implementations, a wrinkle removal score of the two or three dress shirts may be 3.5 or more.

The wrinkle removal score is set by evaluating a wrinkle removal degree based on wrinkle removal force evaluation certified by the Korean Apparel Testing & Research Institute (KATRI).

As represented in wrinkle evaluation standards, a wrinkle removal score of 1 means that excessive wrinkles are present, a wrinkle removal score of 3 means that some wrinkles are present and a wrinkle removal score of 5 means that substantially no wrinkles are present. Basically, the wrinkle removal score of 1 may be a wrinkle removal score acquired immediately after dehydration following washing is performed, and the wrinkle removal score of 5 may be a wrinkle removal score acquired immediately after ironing is performed.

Upon implementation of the all-in-one course, a wrinkle removal score of two or three dress shirts is 3.5 or more, which means that most wrinkles of the dress shirts are removed.

In addition to the excellent wrinkle removal state, the amount of moisture, i.e., the percentage of water contained in the clothes is 5% or less, which means that the clothes have sufficient dryness to allow the user to immediately wear the clothes.

Accordingly, the clothes subjected to the all-in-one course have substantially no wrinkles and also have sufficiently wearable dryness, thus allowing the user to wear the clothes immediately after retrieving the clothes from the drum.

Some implementations may be described as follows on the basis of an implementation time of the operating method.

When the user selects the all-in-one course after inputting two or three dress shirts into the drum, the cleaning step S50, the dehydration step S60, the drying step S70 and the refreshing step S90 are successively performed.

In this case, a time taken to perform the cleaning step S50 and the dehydration step S60 may be about 32 minutes. This time means a time taken until the cleaning step S50 is performed and ended and, thereafter, the dehydration step S60 is performed and ended.

Next, a time taken to perform the drying step S70 is about 20~25 minutes. In some implementations, the drying step S70 is performed for an optimized time in consideration of wrinkle removal and dryness of clothes.

Finally, a time taken to perform the refreshing step S90 is about 25 minutes.

In brief, the time taken to perform the cleaning step S50 and the dehydration step S60, the time taken to perform the drying step S70 and the time taken to perform the refreshing step S90 are respectively about 32 minutes, about 20~25 minutes and about 25 minutes.

In some implementations, two or three dress shirts may have a wrinkle removal score of about 3.5 or more and the percentage of water of about 5% or less after end of the all-in-one course.

Accordingly, when the user retrieves the dress shirts from the drum after end of the all-in-one course, wrinkles of the dress shirts are considerably removed and the dress shirts are sufficiently dried to allow the user to immediately wear the dress shirts.

Usually, when the user retrieves dress shirts from the laundry machine after completion of all strokes, ironing to remove wrinkles from the dress shirts is necessary or the dress shirts are not sufficiently dried.

However, in some implementations, the user who retrieves dress shirts after completion of the all-in-one course from the drum may immediately wear the dress shirts without additional time or cost, which may provide user convenience.

As is apparent from the description above, the laundry machine may provide an operating method for a laundry machine in which washing, drying, and refreshing of clothes may be successively performed as a user selects a single course.

In some implementations, the laundry machine may provide an operating method for a laundry machine in which washing, drying and refreshing of delicate clothes that tend to be easily damaged may be successively performed while preventing damage to the clothes to the maximum extent.

In some implementations, the laundry machine may provide an operating method for a laundry machine, which may ensure successive implementation of washing, drying and refreshing, may prevent damage to clothes, and may achieve removal of wrinkles to a given level or more as well as a given drying degree or more.

In some implementations, the laundry machine may provide an operating method for a laundry machine which may allow a user to wear clothes immediately after retrieving the clothes from the laundry machine without consuming additional time or cost after a single course selected by the user ends. That is, the washing machine may provide a laundry machine and an operating method thereof, which may provide clothes treatment to allow a user to immediately wear clothes without drying or ironing.

In some implementations, a laundry machine and an operating method thereof enables one stop treatment of a small quantity of laundry, such as slightly contaminated dress shirts, from washing to refreshing, and may achieve maximum effects in terms of washing, damage to laundry, wrinkles, use convenience, and treatment time.

What is claimed is:

1. A laundry machine comprising:

a main body that forms an external appearance of the laundry machine;

a tub configured to receive wash water, the tub being placed in the main body;

a drum that is configured to rotate in the tub and to receive clothes;

a control panel configured to receive input from a user, the control panel being installed to the main body;

a course selection part located on the control panel and configured to enable user selection of an operating course from a plurality of operating courses, the plurality of operating courses including a washing course and an all-in-one course;

an option selection part located on the control panel and configured to enable user selection of an option associated with at least one of washing, rinsing, and dehydrating, the option including a drying option for drying laundry after implementation of the washing course; and a controller configured to (i) control operation of the laundry machine based on the selected operating course and the selected option and (ii) based on a user selection of the all-in-one course among the plurality of operating courses for successive and automatic implementation of washing, and drying, control operation of the laundry machine such that the user selection through the option selection part is ignored, and washing and drying of the all-in-one course are sequentially and automatically performed based on a predetermined program without changing a predetermined implementation time of the all-in-one course, wherein the controller is further configured to limit a selection of the one or more options through the option selection part based on the user selection of the all-in-one course.

2. An operating method for a laundry machine, the laundry machine comprising:

a main body that forms an external appearance of the laundry machine;

a tub configured to receive wash water, the tub being placed in the main body;

a drum that is configured to rotate in the tub and to receive clothes;

a control panel configured to receive input from a user, the control panel being installed to the main body;

a course selection part located on the control panel and configured to enable user selection of an operating course from a plurality of operating courses, the plurality of operating courses including a washing course and an all-in-one course;

one or more option selection parts located on the control panel provided separately from the course selection part, the one or more option selection parts being configured to enable user selection of one or more options for the operating course selected by the user, the one or more options including a drying option for drying laundry after implementation of the washing course; and a controller configured to control the operation method based on user input received via the control panel, the operating method comprising:

obtaining a user selection of the all-in-one course among the plurality of operating courses in response to an operating course selection signal generated based on user input received via the course selection part, the all-in-one course including sequentially performing cleaning the clothes, and drying the clothes for a predetermined implementation time; and based on the user selection of the all-in-one course, (i) ignoring a selection of the one or more options directed to changing the predetermined implementation time, and (ii) controlling sequential and automatic performance of the following operations for the predetermined implementation time without changing the predetermined implementation time:

cleaning the clothes by supplying wash water to the drum and washing the clothes; and drying the clothes by supplying hot air to the drum, wherein the operating method further comprises limiting a selection of the one or more options through the one or more option selection parts based on the user selection of the all-in-one course.

3. The operating method according to claim 2, wherein the plurality of operating courses includes a steam usable course that enables a steam cycle for supplying steam to the drum, a steam course that includes the steam cycle, and a steam omission course that omits the steam cycle.

4. The operating method according to claim 3, wherein the all-in-one course includes the steam course.

5. The operating method according to claim 2, wherein the cleaning includes:

washing the clothes using detergent and wash water and rotating the drum;

rinsing the clothes using newly supplied wash water and rotating the drum after draining the detergent and the wash water; and dehydrating the clothes using centrifugal force by rotating the drum at high speed, wherein the washing, the rinsing, the dehydrating, and the drying are sequentially performed based on the user selection of the all-in-one course.

6. The operating method according to claim 5, wherein the one or more option selection parts include an option selection part associated with the washing, an option selection part associated with the rinsing, an option selection part associated with the dehydrating, and an option selection part associated with the drying.

7. The operating method according to claim 6, wherein the option selection part associated with the washing includes a steam selection part, a wash water temperature selection part, and a washing degree selection part.

8. The operating method according to claim 7, wherein a selection of the option selection part associated with the washing is limited based on the user selection of the all-in-one course.

9. The operating method according to claim 6, wherein the option selection part associated with the washing among the one or more option selection parts includes a steam selection part, and wherein the steam selection part is deactivated based on the user selection of the all-in-one course.

10. The operating method according to claim 6, wherein the option selection part associated with the rinsing includes a rinsing frequency selection part.

11. The operating method according to claim 10, wherein the rinsing frequency selection part is deactivated based the user selection of the all-in-one course.

12. The operating method according to claim 6, wherein the option selection part associated with the dehydrating includes a dehydration rotation speed selection part, and wherein selection of the option selection part associated with the dehydrating is limited based on the user selection of the all-in-one course.

13. The operating method according to claim 6, wherein the option selection part associated with the drying includes a hot air temperature selection part and a drying degree selection part.

14. The operating method according to claim 13, wherein a selection of the option selection part associated with the drying is limited based on the user selection of the all-in-one course.

15. The operating method according to claim 3, further comprising setting, based on the user selection of the all-in-one course, a temperature of wash water to a predetermined value of about 40 degrees Celsius and an operating rate of a motor to a predetermined value of about 1/3 in the washing, and limiting change of the temperature of the wash water and the operating rate of the motor, wherein the operating rate of the motor is defined as a motor on time divided by the a total time of the motor on time and a motor off time during the all-in-one course.

16. The operating method according to claim 5, further comprising setting, based on the user selection of the all-in-one course, a dehydration RPM to a predetermined value of about 600 in the dehydrating, and limiting change of the dehydration RPM.

17. The operating method according to claim 2, further comprising setting, based on the user selection of the all-in-one course, a temperature of hot air to a predetermined value of about 45 degrees Celsius and an operating rate of a motor to a predetermined value of 1/16 in the drying, and limiting change of the temperature of the hot air and the operating rate of the motor, wherein the operating rate of the motor is defined as a motor on time divided by the a total time of the motor on time and a motor off time during the all-in-one course.

18. The operating method according to claim 2, further comprising setting, based on the user selection of the all-in-one course, a temperature of wash water and an operating rate of a motor during the cleaning to each have predetermined values and limiting changes of the temperature of the wash water and the operating rate of the motor during the cleaning, and setting a temperature of hot air and an operating rate of the motor during the drying to each have predetermined values and limiting changes of the temperature of the hot air and the operating rate of the motor during the drying.

19. The operating method according to claim 2, further comprising dehydrating the clothes using centrifugal force by rotating the drum at high speed, the dehydrating being between the cleaning and the drying, and performing, based on the user selection of the all-in-one course, the cleaning and the dehydrating for about 32 minutes, and the drying for about 20 to 25 minutes.

20. The operating method according to claim 2, wherein limiting the selection of the one or more options comprises:

outputting an alarm sound based on the selection of the one or more options in a state in which the all-in-one course is selected;

deactivating the one or more option selection parts; or ignoring the one or more options selected in the state in which the all-in-one course is selected.

* * * * *